US005782351A

United States Patent [19]

Shoptaugh

[11] Patent Number: 5,782,351

[45] Date of Patent: Jul. 21, 1998

[54] CONTAINER

[76] Inventor: Philip LeRoy Shoptaugh, 5860 Buena Vista Ave., Oakland, Calif. 94618

[21] Appl. No.: 759,570

[22] Filed: Dec. 5, 1996

[51] Int. Cl.[6] ..... B65D 85/20

[52] U.S. Cl. ..... 206/315.1; 273/260; 273/280; 273/289

[58] Field of Search ..... 206/315.1, 579; 220/212; 273/242, 258, 260, 269, 280, 288, 289

[56] References Cited

U.S. PATENT DOCUMENTS

| | | | |
|---|---|---|---|
| 4,022,473 | 5/1977 | Foley | 273/280 |
| 4,299,389 | 11/1981 | Miolo | 273/260 |
| 4,513,974 | 4/1985 | Lin | 206/579 |
| 4,624,464 | 11/1986 | Propsom | 273/280 |
| 4,781,384 | 11/1988 | Bois | 206/315.1 |
| 5,280,913 | 1/1994 | Sirk | 206/311 |
| 5,344,154 | 9/1994 | Langstroth | 273/260 |

FOREIGN PATENT DOCUMENTS

| | | | |
|---|---|---|---|
| 2587906 | 4/1987 | France | 273/260 |
| 2144046 | 2/1985 | United Kingdom | 273/260 |

*Primary Examiner*—Paul T. Sewell
*Assistant Examiner*—Nhan T. Lam
*Attorney, Agent, or Firm*—Wood, Herron & Evans, L.L.P.

[57] ABSTRACT

A container is disclosed as including a top part releasably engageable with a bottom part having an upper surface, wherein the top part is engageable with the bottom part in a first position to form a substantially enclosed container, and the top part is engageable with the bottom part in a second position whereby at least one exposed storage area is formed between both the top part and bottom part. A container for a game is also disclosed as including a cover, and a base having a playing surface on which a plurality of playing pieces are movable, and the cover is releasably engageable with the base in a first position to form a substantially enclosed container, and the cover is engageable with the base in a second position whereby at least one exposed storage area is formed between both the cover and the base.

22 Claims, 7 Drawing Sheets

CONTAINER

FIELD OF THE INVENTION

This invention relates to a container, and in particular a container for a board game unit.

BACKGROUND OF THE INVENTION

There are existing relatively small sized board game units which are designed to be easily carried around, e.g. for play during travel. Such board game units usually include a cover which may be releasably engaged with a base. The base includes a surface on which playing pieces, e.g. counters, may be moved. For board games in which playing pieces may be captured in the course of play, space has to be provided to house such pieces, which may otherwise be easily lost in view of their small size. This adds to the overall size of the board game units. It is thus an object to provide a container in which the aforesaid shortcoming is mitigated.

SUMMARY OF THE INVENTION

According to a first aspect of the present invention, there is provided a container comprising a first member releasably engageable with a second member having an upper surface, wherein the first member is engageable with the second member in a first position to form a substantially enclosed container, and wherein the first member is engageable with the second member in a second position whereby at least one exposed storage area is formed between both the first member and the second member.

Advantageously, the second member may comprise a lower surface with which the first member is releasably engageable in the second position.

Conveniently, the first member may be releasably engageable with the second member in the second position to form a plurality of exposed storage areas.

Suitably, the first member may be releasably engageable with the second member to form four exposed storage areas.

The exposed storage area may advantageously be formed among at least part of a cover member of the first member, at least part of a wall member of the first member, and at least part of a wall member of the second member.

When the first member is engaged with the second member in the second position, the cover member of the first member may conveniently comprise a support on which the container stands.

When the first member is engaged with the second member in the second position, the horizontal diagonal axis of the first member may suitably intersect the horizontal diagonal axis of the second member at an acute angle, which may be conveniently be substantially 45°.

Suitably, when the first member is engaged with the second member in the second position, the horizontal diagonal axis of the first member may alternatively be parallel to the horizontal diagonal axis of the second member.

According to a second aspect of the present invention, there is provided a container for a game, which container comprises a cover, and a base having a playing surface on which a plurality of playing pieces are movable, wherein the cover is releasably engageable with the base in a first position to form a substantially enclosed container, and wherein the cover is engageable with the base in a second position whereby at least one exposed storage area is formed between both the cover and the base.

Advantageously, the base may comprise a lower surface with which the cover is releasably engageable in the second position.

Conveniently, the cover may be releasably engageable with the second member in the second position to form a plurality of exposed storage areas.

Suitably, the cover may be releasably engageable with the base to form four exposed storage areas.

The exposed storage area may advantageously be formed among at least part of a cover member of the cover, at least part of a wall member of the cover, and at least part of a wall member of the base.

When the cover is engaged with the base in the second position, the cover member of the cover may conveniently comprise a support on which the container stands.

When the cover is engaged with the base in the second position, the horizontal diagonal axis of the cover may suitably intersect the horizontal diagonal axis of the base at an acute angle, which may conveniently be substantially 45°.

Suitably, when the cover is engaged with the base in the second position, the horizontal diagonal axis of the cover may alternatively be parallel to the horizontal diagonal axis of the base.

Advantageously, the playing surface may comprise a plurality of apertures each for receiving therethrough at least part of a playing piece.

According to a third aspect of the present invention, there is provided a board game unit comprising a plurality of playing pieces and a container comprising a cover, and a base having a playing surface on which a plurality of playing pieces are movable, wherein the cover is releasably engageable with the base in a first position to form a substantially enclosed container, and wherein the cover is engageable with the base in a second position whereby at least one exposed storage area is formed between both the cover and the base.

Advantageously, the playing surface may comprise a plurality of apertures each for receiving at least part of a playing piece.

Conveniently, each playing piece may comprise a downwardly extending member receivable through the apertures of the playing surface.

Suitably, the game may be a board game, e.g. chess.

DESCRIPTIONS OF THE PREFERRED EMBODIMENT

Figure 1:
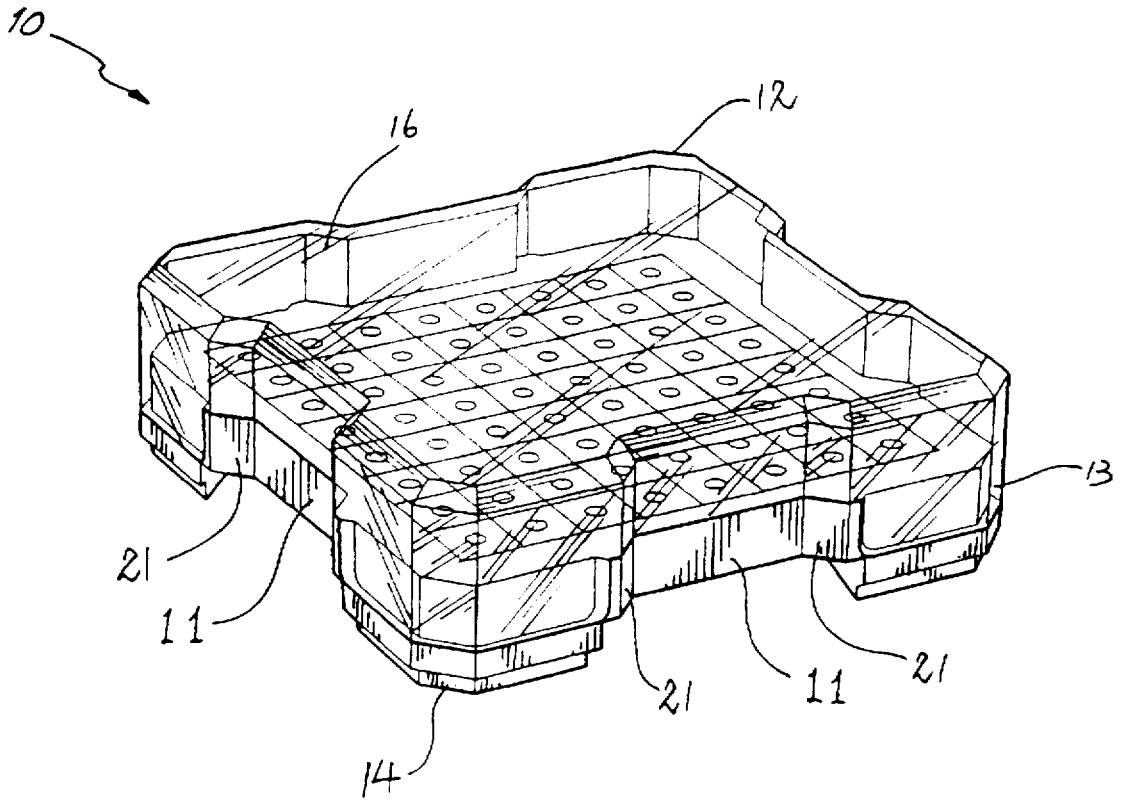
FIG. 1 shows a perspective view of a container according to the present invention in a first configuration.
Figure 2:
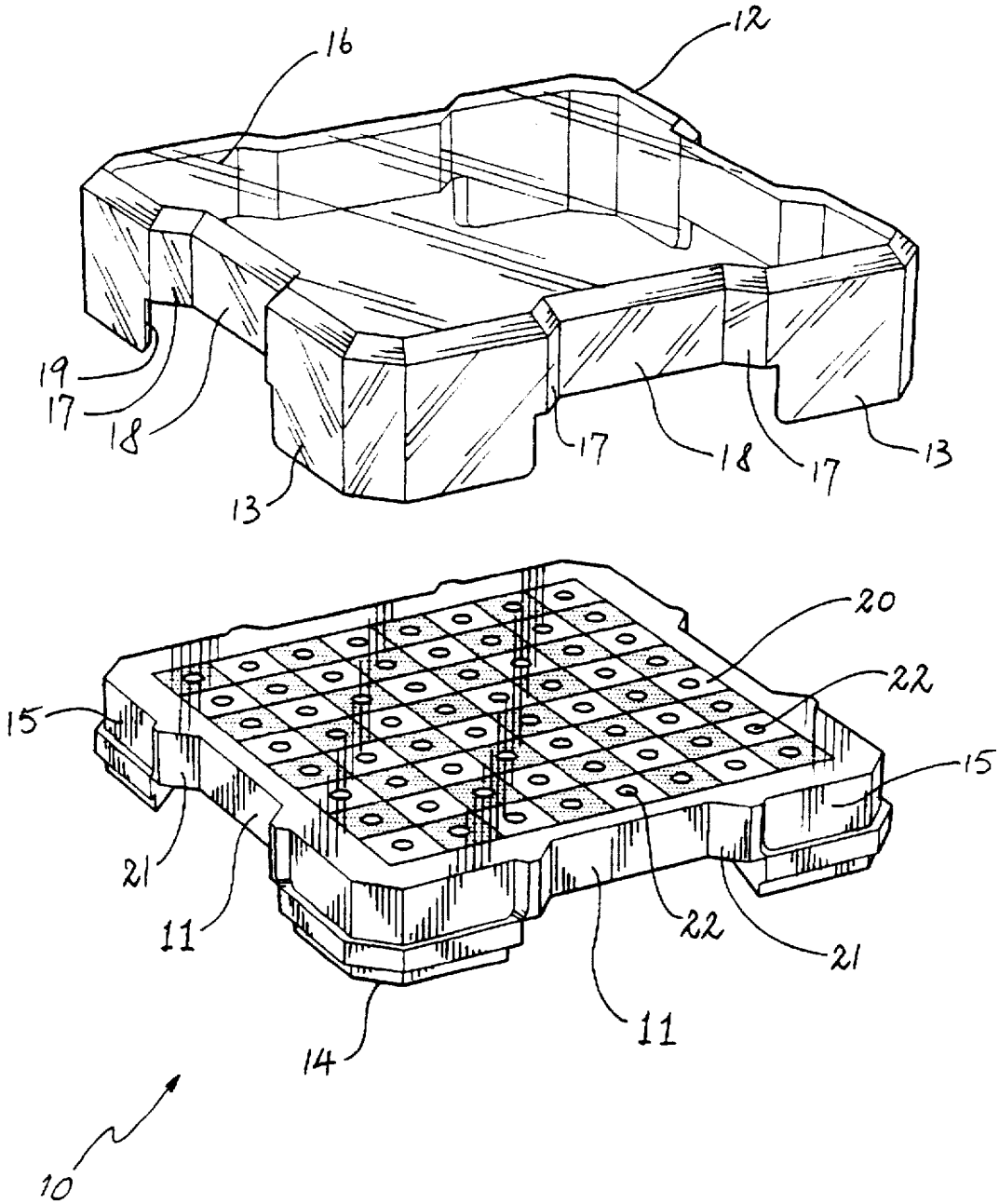
FIG. 2 shows an exploded view of the container shown in FIG. 1.

FIGS. 1 and 2 show a container according to the present invention generally designated as 10. The container 10 includes a top part 12 and a bottom part 14 which are releasably engageable with each other. The top part 12 includes a cover surface 16 adjoining upstanding walls 18. On the upper surface of the bottom part 14 is a board 20 with a number of holes 22. When the container 10 is arranged in the configuration as shown in FIG. 1, the board 20 is wholly covered by the top part 12. The playing pieces (not shown here) may be stored in the cavity formed between the top part 12 and the bottom part 14. The whole container 10, together with the playing pieces, may then be carried around as a set.

Figure 3:
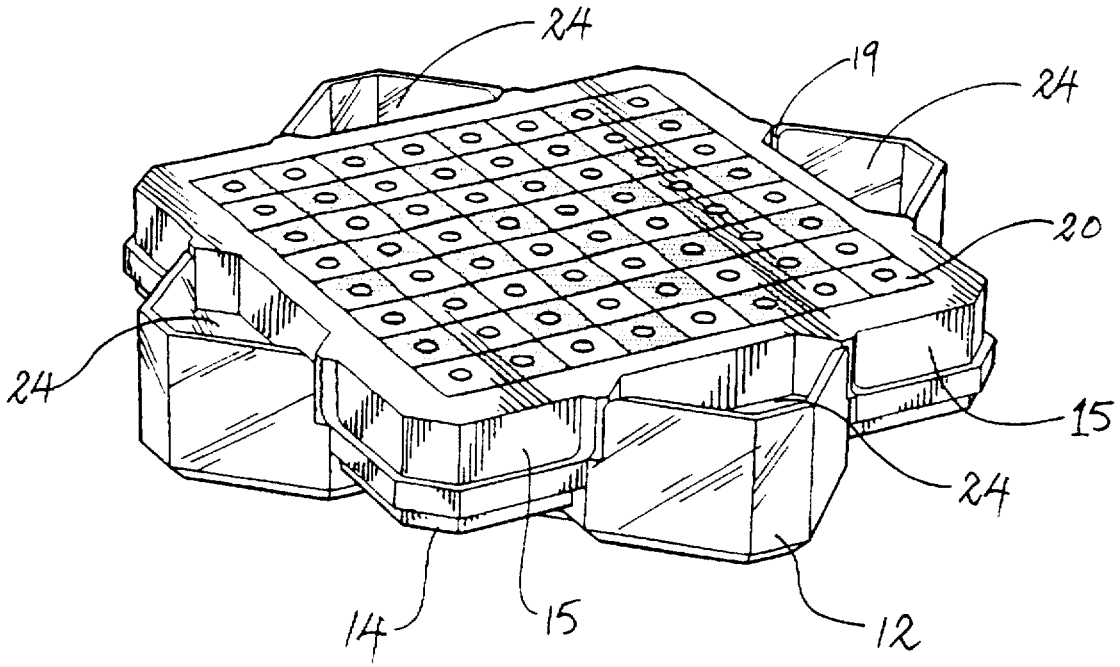
FIG. 3 shows a perspective view of the container shown in FIG. 1 in a second configuration.
Figure 4:
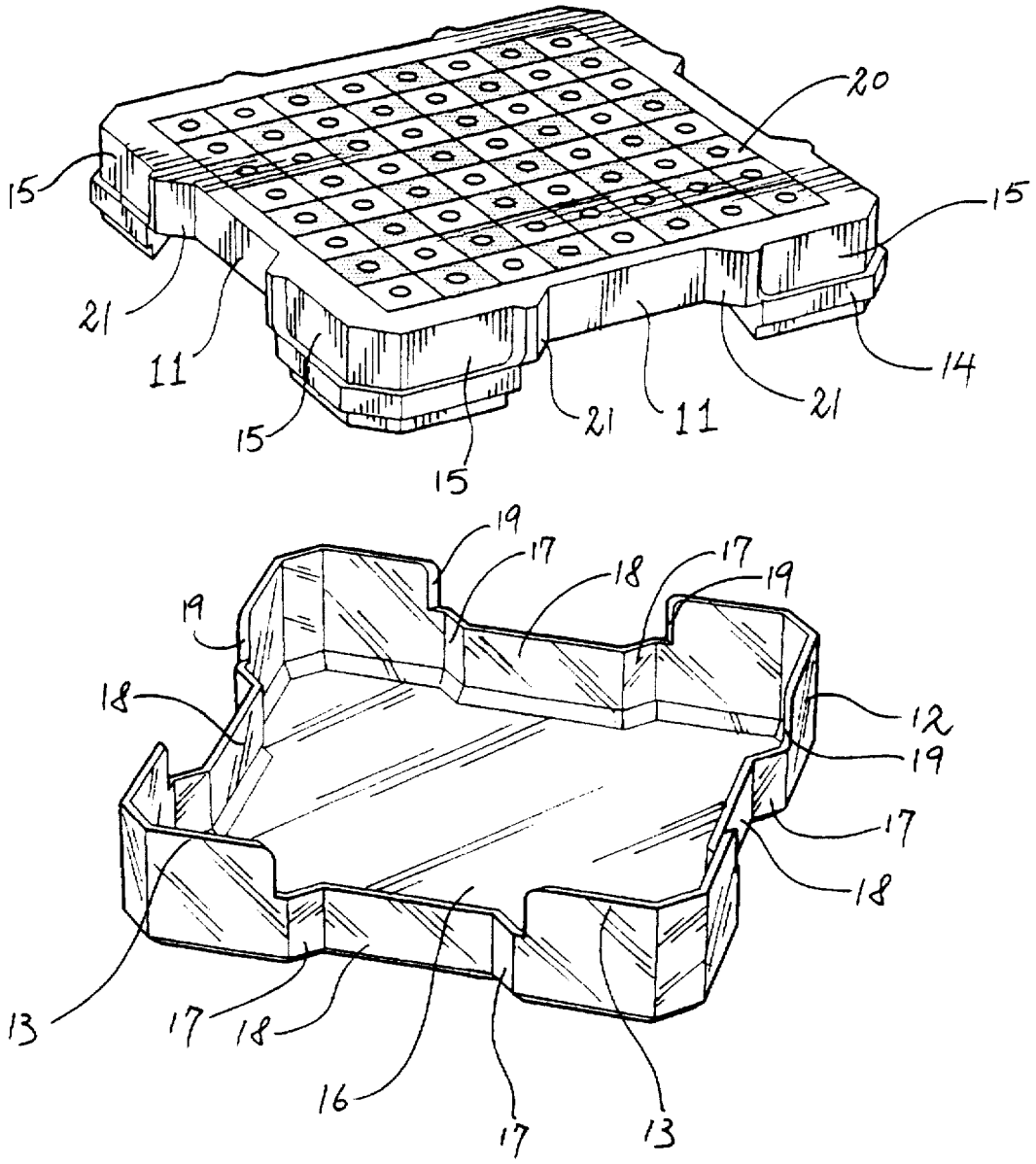
FIG. 4 shows an exploded view of the container shown in FIG. 3.

The top part 12 may be turned upside and rotated by 45° about a vertical axis to engage with the bottom part 14 in a star-like configuration, as shown in FIGS. 3 and 4. The cover surface 16 now constitutes the base to support the container 10. As can be seen, four exposed storage spaces 24 are formed between the top part 12 and the bottom part 14.

Figure 5:
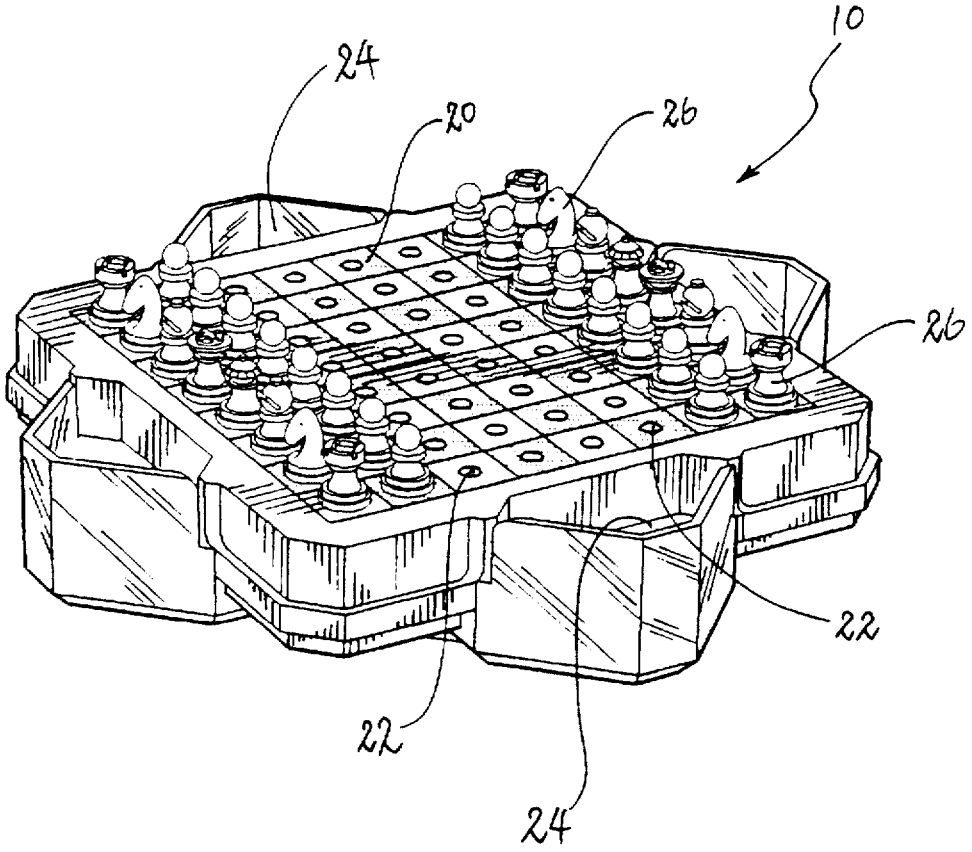
FIG. 5 shows the container shown in FIG. 3 with chess pieces.
Figure 6:
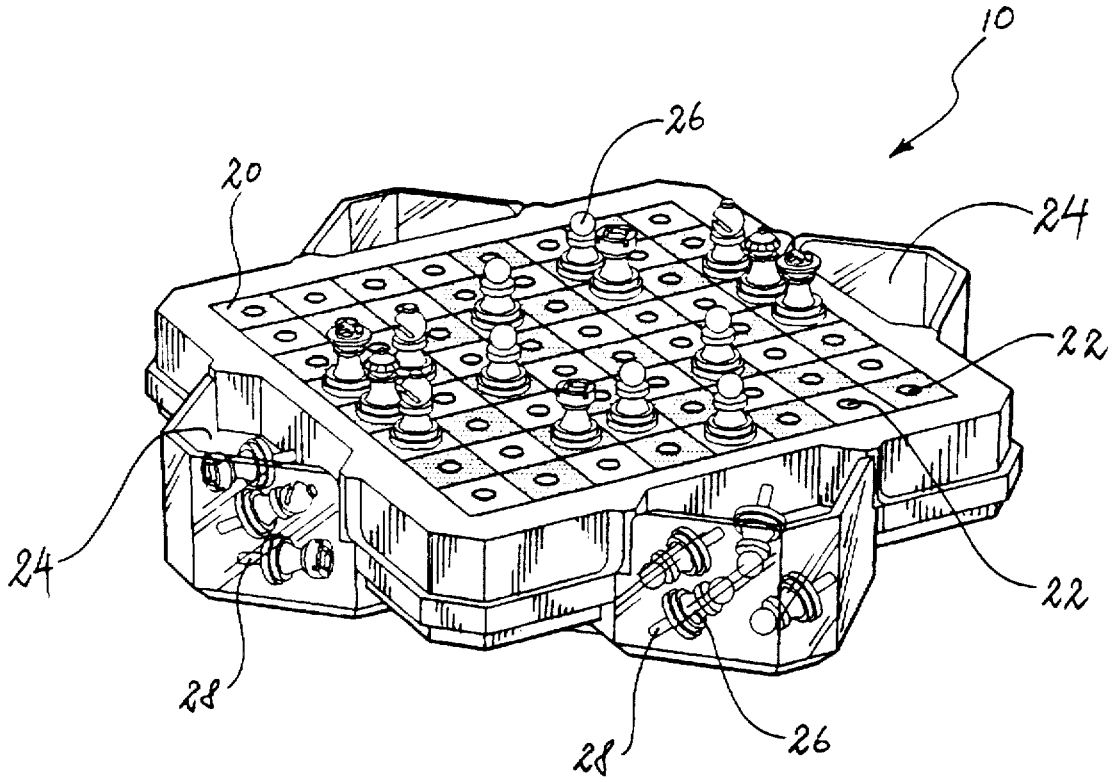
FIG. 6 shows the container shown in FIG. 5 with some of the chess pieces in the storage spaces.

As shown in FIGS. 5 and 6, the container 10 according to the present invention may be used as one for a board game, e.g. chess. A number of chess pieces 26 each with a downwardly extending pin 28 are provided. The pins 28 are sized and shaped to be received through the holes 22. The chess pieces 26 may thus be moved around the board 20, and captured chess pieces 26 may be placed in the exposed storage spaces 24. Such an arrangement can significantly reduce the chance of the chess pieces 26 being lost during play.

As can be seen in FIGS. 1 to 4, sides 11 of the bottom part 14 are indented, which make the exposed storage spaces larger. The walls 18 of the top part 12 include lip members 13 which are flush with recessed corner walls 15 of the bottom part 14 when the top part 12 and the bottom part 14 are engaged as shown in FIG. 1.

The upper part 12 includes bevelled sides 17 and bevelled edges 19, and the lower part 14 includes bevelled sides 21. In the position as shown in FIG. 3, the bevelled edges 19 of the top part 12 engages the lower part 14.

When in the position shown in FIG. 3, the bottom part 14 sits in indented sides of the top part 12, such that the lip members 13 and the indented sides of the bottom part 14 form four exposed storage spaces.

Figure 7:
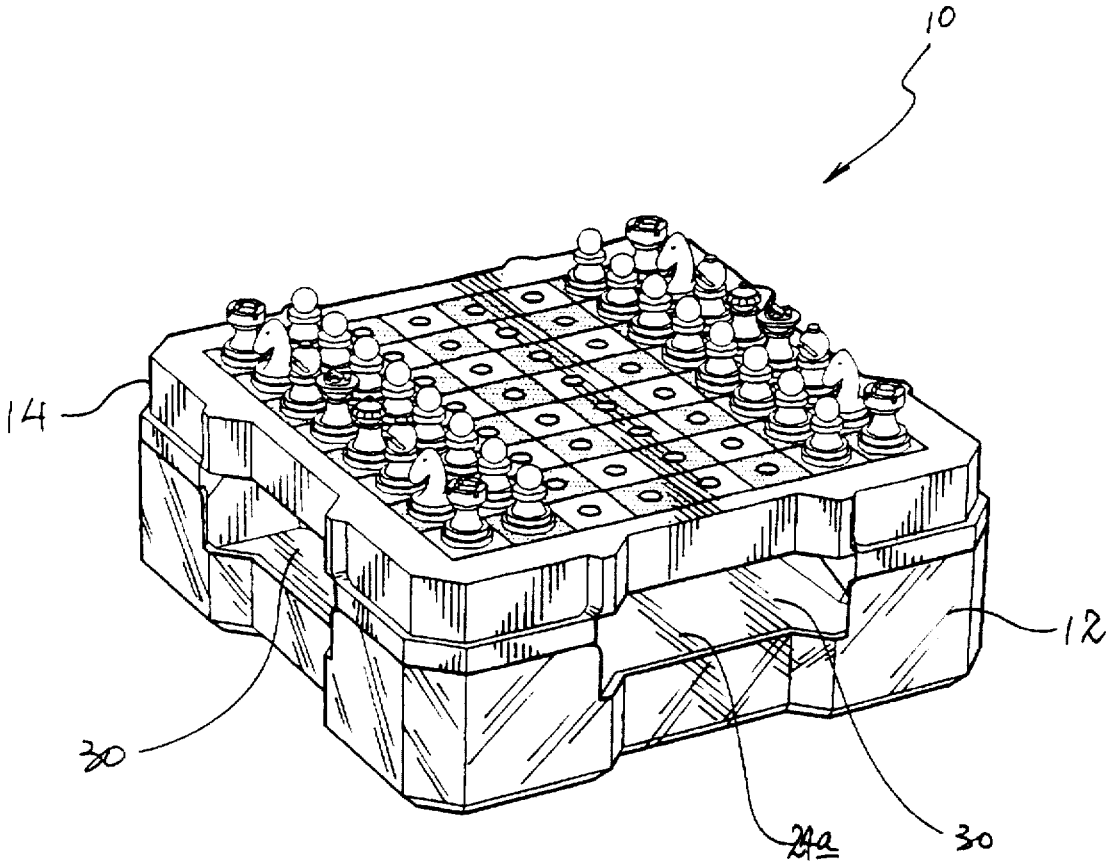
FIG. 7 shows a perspective view of the container shown in FIG. 1 in a third configuration, and with chess pieces.

As shown in FIG. 7, the top part 12 and the bottom part 14 may be engaged with each other in a further configuration in which a single exposed space **24*a* is formed between the top part 12 and the bottom part 14. The exposed space 24*a* is accessible through four openings 30, two of which being shown in FIG. 7. In this configuration, the horizontal diagonal axis of the top part 12 is parallel to the horizontal diagonal axis of the bottom part 14**.

It should be understood that the above only illustrates a preferred embodiment of the present invention. Various alterations may be made to this embodiment without departing from the spirit of the invention. In particular, the container may alternatively be used for Chinese checkers, in which case the container will be of a generally hexagonal shape.

I claim:

1. A container comprising a first member releasably engageable with a second member having an upper surface, wherein the first member is engageable with the second member in a first position in which the first member is supported on the second member and collectively from a substantially enclosed container, wherein the first member is engageable with the second member in a second position in which the second member is supported on the first member whereby at least one exposed storage area is formed between both the first member and the second member, wherein the exposed storage area is formed among at least part of a cover member of the first member, at least part of a wall member of the first member, and at least part of a wall member of the second member, and wherein when the first member is engaged with the second member in the second position, at least part of the wall member of the first member intersects at least part of the wall member of the second member at an angle selected from a group consisting of an obtuse angle and an acute angle.

2. A container according to claim 1 wherein the second member comprises a lower surface with which the first member is releasably engageable in the second position.

3. A container according to claim 1 wherein the first member is releasably engageable with the second member in the second position to form a plurality of exposed storage areas.

4. A container according to claim 3 wherein the first member is releasably engageable with the second member to form four exposed storage areas.

5. A container according to claim 1 wherein when the first member is engaged with the second member in the second position, the container is supportable on a surface by said cover member.

6. A container according to claim 1 wherein said obtuse angle is substantially 135°.

7. A container according to claim 1 wherein when the first member is engaged with the second member in the second position, at least part of the wall member of the first member is co-planar with at least part of the wall member of the second member.

8. A container according to claim 1 wherein said acute angle is substantially 45°.

9. A container for a game, which container comprises a cover, and a base having a playing surface on which a plurality of playing pieces are movable, wherein the cover is releasably engageable with the base in a first position in which the cover is supported on the base and collectively form a substantially enclosed container, wherein the cover is releasably engageable with the base in a second position in which the base is supported on the cover whereby at least one exposed storage area is formed among at least part of a cover member of the cover, at least part of a wall member of the cover, and at least part of a wall member of the base, and wherein when the cover is engaged with the base in the second position, at least part of the wall member of the cover intersects at least part of the wall member of the base at an angle selected froma group consisting of an obtuse angle and an acute angle.

10. A container according to claim 9 wherein the base comprises a lower surface with which the cover is releasably engageable in the second position.

11. A container according to claim 9 wherein the cover is releasably engageable with the base in the second position to form a plurality of exposed storage areas.

12. A container according to claim 11 wherein the cover is releasably engageable with the base to form four exposed storage areas.

13. A container according to claim 9 wherein when the cover is engaged with the base in the second position, the container is supportable on a surface by said cover member.

14. A container according to claim 9 wherein said obtuse angle is substantially 135°.

15. A container according to claim 9 wherein when the cover is engaged with the base in the second position, at least part of the wall member of the cover is co-planar with at least part of the wall member of the base.

16. A container according to claim 9 wherein the playing surface comprises a plurality of apertures each for receiving therethrough at least part of a playing piece.

17. A container according to claim 9 wherein said acute angle is substantially 45°.

18. A game comprising a plurality of playing pieces and a container which comprises a cover, and a base having a playing surface on which a plurality of playing pieces are movable, wherein the cover is releasably engageable with the base in a first position in which the cover is supported on the base and collectively form a substantially enclosed container, wherein the cover is releasably engageable with the base in a second position in which the base is supported on the cover whereby at least one exposed storage area is formed among at least part of a cover member of the cover, at least part of a wall member of the cover, and at least part of a wall member of the base, and wherein when the cover is engaged with the base in the second position, at least part of the wall member of the cover intersects at least part of the wall member of the base at an angle selected from a group consisting of an obtuse angle and an acute angle.

19. A game according to claim 18 wherein the playing surface comprises a plurality of apertures each for receiving at least part of a playing piece.

20. A game according to claim 18 wherein each playing piece comprises a downwardly extending member receivable through the apertures of the playing surface.

21. A game according to claim 15 wherein the game is a board game.

22. A game according to claim 21 wherein the game is chess.

* * * * *